US006817151B2

(12) United States Patent
Foderberg et al.

(10) Patent No.: US 6,817,151 B2
(45) Date of Patent: Nov. 16, 2004

(54) CHANNEL-REINFORCED CONCRETE WALL PANEL SYSTEM

(76) Inventors: Joel Foderberg, 13904 Lucille St., Overland Park, KS (US) 66221; Gary Foderberg, 11000 W. 177th Ter., Olathe, KS (US) 66062

( * ) Notice: Subject to any disclaimer, the term of this patent is extended or adjusted under 35 U.S.C. 154(b) by 0 days.

(21) Appl. No.: 10/404,588

(22) Filed: Mar. 31, 2003

(65) Prior Publication Data

US 2004/0187419 A1 Sep. 30, 2004

(51) Int. Cl.[7] ..... E04B 1/16

(52) U.S. Cl. ..... 52/414; 52/309.12; 52/309.17; 52/327

(58) Field of Search ..... 52/327, 326, 328, 52/125.5, 125.6, 125.4, 414, 309.7, 432, 477, 309.12, 309.16, 309.17

(56) References Cited

U.S. PATENT DOCUMENTS 2,945,328 A * 7/1960 Webb ..... 52/327
3,557,511 A * 1/1971 Curran ..... 52/414
3,956,864 A * 5/1976 Fung ..... 52/414
4,602,467 A * 7/1986 Schilger ..... 52/319
4,751,803 A * 6/1988 Zimmerman ..... 52/414
4,972,537 A * 11/1990 Slaw, Sr. ..... 14/77.1
5,758,463 A * 6/1998 Mancini, Jr. ..... 52/309.12
5,809,703 A * 9/1998 Kelly ..... 52/125.5
6,000,194 A * 12/1999 Nakamura ..... 52/783.17
6,003,278 A * 12/1999 Weaver et al. ..... 52/414
6,668,507 B2 * 12/2003 Blanchet ..... 52/601

* cited by examiner

*Primary Examiner*—Anita King
*Assistant Examiner*—Tan Le
(74) *Attorney, Agent, or Firm*—Hovey Williams LLP

(57) ABSTRACT

A wall system employing channel-reinforced lightweight precast concrete wall panels. The precast wall panels include a concrete slab, a pair of spaced-apart elongated generally parallel metallic side channels, and a plurality of spaced-apart elongated generally parallel metallic attachment channels. The side channels and attachment channels are partially embedded in the slab and extend substantially perpendicular to one another. Each wall panel can be coupled to a support wall by extending self-tapping screws through metallic wall framing members and the attachment channels at locations where the framing members and attachment channels cross.

11 Claims, 6 Drawing Sheets

CHANNEL-REINFORCED CONCRETE WALL PANEL SYSTEM

BACKGROUND OF THE INVENTION

1. Field of the Invention

The present invention relates generally to exterior wall systems for commercial and residential structures. In another aspect, the invention concerns lightweight precast concrete wall panels.

2. Description of the Prior Art

Precast concrete wall panels have been used for years to provide durable and aesthetically pleasing exterior walls. One disadvantage of traditional precast concrete wall panels is the weight of the panels. The high weight of conventional precast wall panels can make them expensive to ship and erect. Further, because heavy wall panels cause deflection of structural steel wall members supporting the panels, the strength of the steel frame of a building may need to be increased in order to adequately support concrete wall panels without excessive deflection. Such a need to increase the strength of the structural steel members of a building can add significantly to the overall cost of the building.

In recent years, several lightweight alternatives to traditional precast concrete wall panels have been used. One such system is commonly known as EIFS (Exterior Insulation and Finish System). EIFS is a multi-layered exterior wall system that typically consists of a lightweight pliable insulation board covered with a fiberglass reinforced base coat that is coated with a colored acrylic finish coat. Although EIFS is lightweight and provides thermal insulation, a number of drawbacks are associated with EIFS. For example, EIFS walls have a tendency to crack and allow moisture to seep between the EIFS layers or between the innermost EIFS layer and the interior wall. In either case, such leakage can cause water damage and/or damage due to mold or mildew. In fact, the tendency of EIFS wall systems to leak has caused many insurance companies to stop writing policies covering EIFS structures. A further disadvantage of EIFS is its lack of durability. For example, simply bumping an EIFS wall with a lawn mower or other equipment during routine lawn maintenance can physically and visibly damage the EIFS wall, thereby necessitating expensive repair. Another problem with EIFS is the inability to form a true caulk joint at the edge of the wall. This inability to form a true caulk joint is caused by the fact that EIFS walls lack a sufficiently thick rigid edge. A proper caulk joint typically requires at least one inch of rigid edge so that a backer-rod can be inserted into a joint and a bead of caulk can fill the joint and seal against at least one half inch of the rigid edge. This allows the seal to maintain integrity during normal shifting and expansion/contraction of the structure. Thus, the lack of a true caulk joint in EIFS walls can contribute to moisture leakage.

Another lightweight wall system that has been introduced in recent years employs precast GFRC (Glass Fiber Reinforced Concrete) wall panels. GFRC wall panels are relatively strong compared to EIFS, but have a number of drawbacks. The main drawback of GFRC wall panels is expense. The making of GFRC wall panels is a labor intensive process wherein concrete and glass fibers are sprayed in a form. In addition to high labor costs associated with GFRC fabrication, the material cost of the glass fibers adds significantly to the overall cost of a GFRC wall panel.

Another relatively lightweight wall panel system that is being used today is commonly known as "slender wall." Slender wall prefabricated wall panels typically include a relatively thin steel-reinforced concrete slab with structural steel framing rigidly attached to one side of the slab. A disadvantage of the slender wall system is that it requires the concrete supplier to fabricate the metal frame backup system, which requires a significant amount of design and fabrication time. Another disadvantage is that the inside face of the metal frame must be in near perfect alignment for proper drywall attachment.

OBJECTS AND SUMMARY OF THE INVENTION

Responsive to these and other problems, it is an object of the present invention to provide a lightweight, durable, and inexpensive prefabricated wall panel system.

A further object of the invention is to provide a light weight prefabricated wall panel of sufficient rigidity and thickness so that a proper caulk joint can be formed around the edge of the panel.

Another object of the invention is to provide a prefabricated wall panel system that can easily be attached to a thin metal framing member (e.g., a metal stud or C/Z purlin) of a support wall.

Still another object of the invention is to provide a lightweight concrete wall panel that is strong enough to withstand conventional handling and transporting methods without cracking.

Yet another object of the invention is to provide an improved method of constructing a wall using lightweight precast concrete wall panels.

It should be understood that not all of the above-listed objects need be accomplished by the present invention, and further objects and advantages of the invention will be apparent from the following detailed description of the preferred embodiment, the drawings, and the claims.

Accordingly, in one embodiment of the present invention, there is provided a lightweight precast wall panel comprising a concrete slab, a pair of elongated spaced-apart first channels, and a plurality of elongated spaced-apart second channels. The first channels extend substantially parallel to one another. The second channels extend substantially parallel to one another. The first and second channels are partially embedded in the slab and extend substantially perpendicular to one another. At least some of the second channels are disposed between the first channels.

In another embodiment of the present invention, there is provided a method of constructing a wall comprising the steps of: (a) erecting a support wall having a plurality of generally parallel spaced-apart elongated metallic outer wall framing members; (b) positioning a precast concrete wall panel adjacent the support wall, with the wall panel including a concrete slab, a pair of generally parallel spaced-apart elongated metallic side channels, and a plurality of generally parallel spaced-apart elongated metallic attachment channels, wherein the side channels and attachment channels extend substantially perpendicular to one another, at least some of the attachment channels are disposed between the side channels, and the side channels and attachment channels are partially embedded in the slab; and (c) coupling the wall panel to the support wall by extending self-tapping screws through the wall framing members and the attachment channels at attachment locations where the attachment channels and the framing members cross.

In still another embodiment of the present invention, there is provided a precast concrete wall system comprising a support wall, a precast wall panel, and a plurality of fasteners. The support wall includes a plurality of generally parallel spaced-apart elongated metallic framing members. The precast wall panel includes a concrete slab, a pair of generally parallel spaced-apart elongated metallic side channels, and a plurality of generally parallel spaced-apart elongated metallic attachment channels. The attachment channels are elongated in a direction that is substantially perpendicular to the direction of elongation of the side channels and the framing members. The side channels and attachment channels are partially embedded in the slab. The fasteners extend through the framing members and attachment channels at attachment locations where the framing members and attachment channels cross.

BRIEF DESCRIPTION OF THE DRAWING FIGURES

A preferred embodiment of the present invention is described in detail below with reference to the attached drawing figures, wherein.

Figure 8:
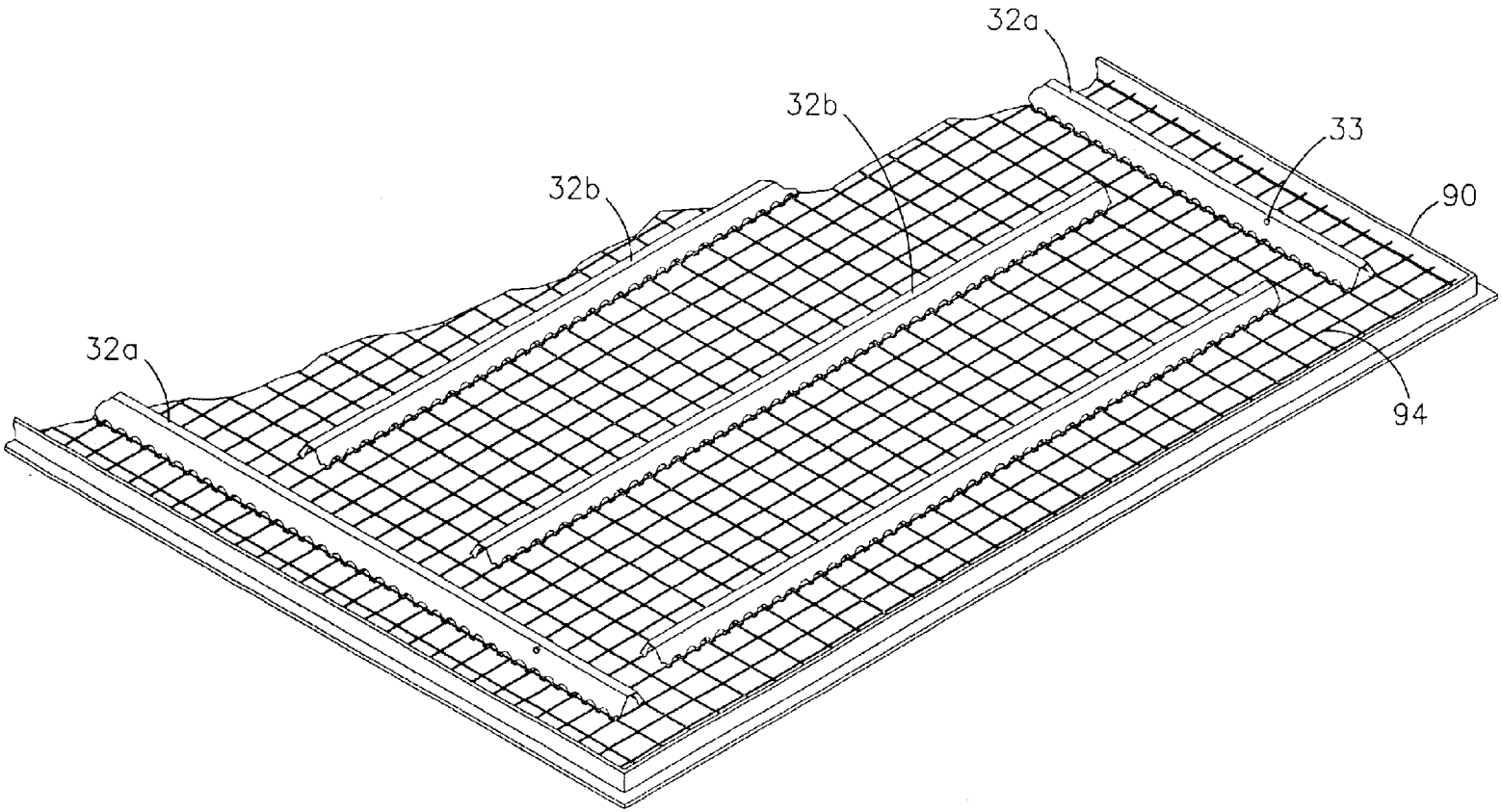
Figure 9:
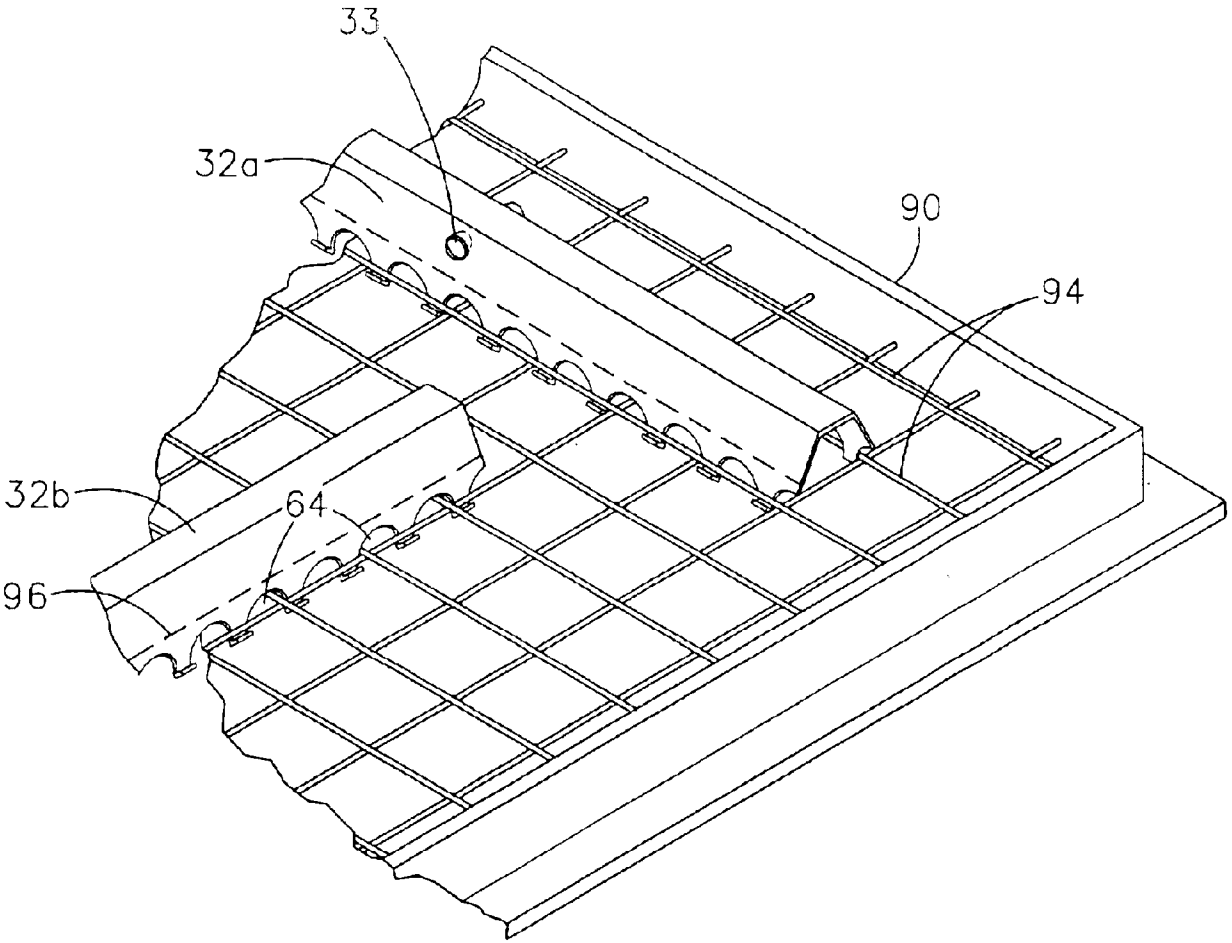

FIG. 8 is a perspective view of a concrete wall panel form system, particularly illustrating the manner in which the elongated channels and the reinforcing members are configured in the form prior to placing concrete in the form; and FIG. 9 is an enlarged perspective view of the concrete wall panel form system shown in FIG. 8, particularly illustrating the manner in which the reinforcing members extend through notches in the metallic channels.

DETAILED DESCRIPTION OF THE PREFERRED EMBODIMENT

Figure 1:
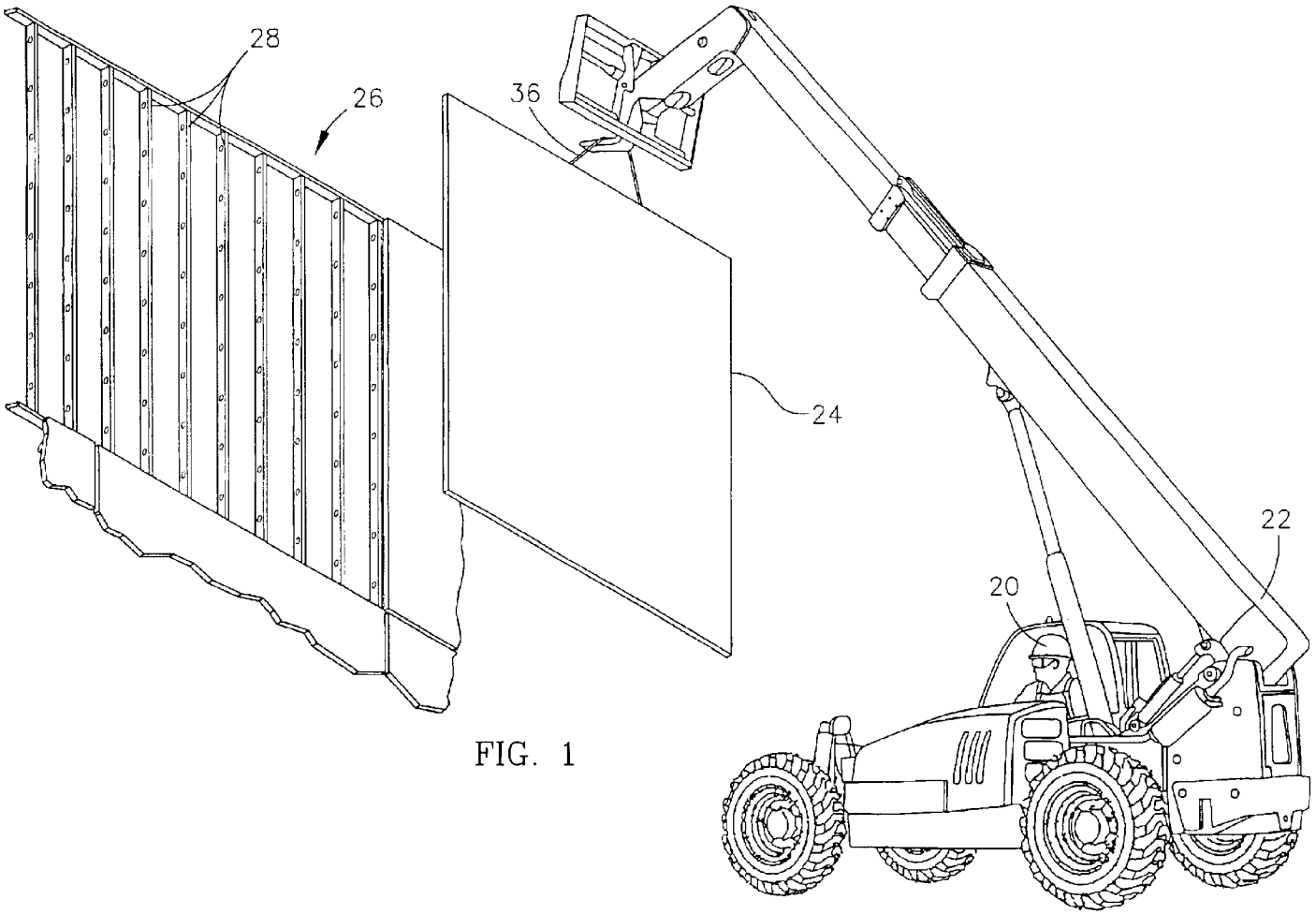
FIG. 1 is a perspective view of a wall system being constructed in accordance with the principles of the present invention, particularly illustrating the manner in which a prefabricated wall panel is erected on a support wall having a plurality of thin metal framing members.

Referring initially to FIG. 1, an operator 20 of a lift 22 is shown performing the operation of placing a prefabricated wall panel 24 on a structural or nonstructural support wall 26. Support wall 26 is preferably an exterior building wall that includes a plurality of spaced-apart generally parallel elongated thin metal framing members 28 for supporting wall panel 24. Metal framing members 28 can be any thin metal member such as, for example, conventional C-shaped metal studs, C-shaped purlins, or Z-shaped purlins. The orientation of metal framing members 28 can be either vertical (typical for metal studs) or horizontal (typical for C/Z purlins).

Figure 2:
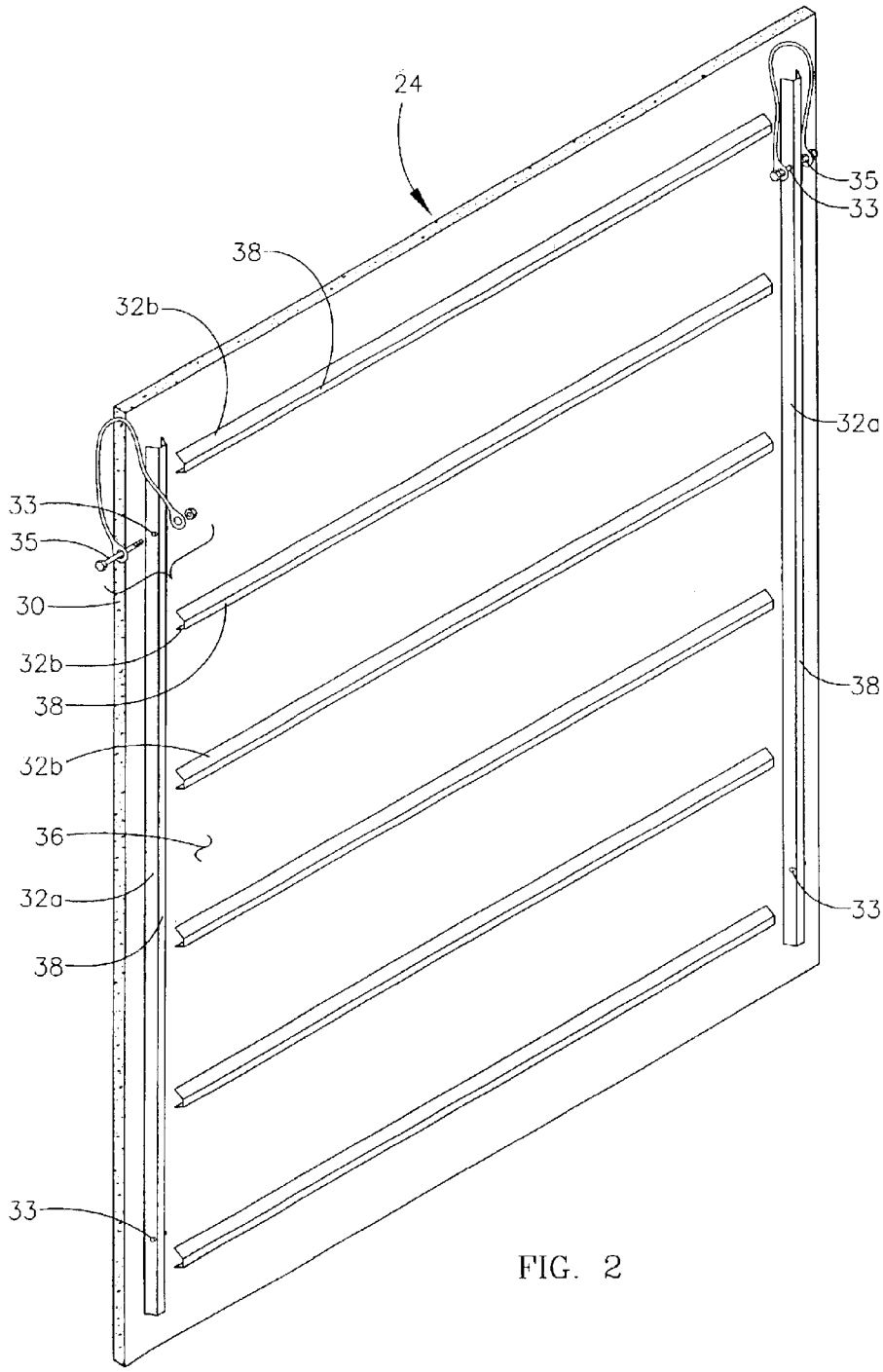
FIG. 2 is a perspective view of a prefabricated wall panel constructed in accordance with the principles of the present invention, particularly illustrating a plurality of elongated metallic side channels and attachment channels partially embedded in a concrete slab and protruding from an inside surface of the slab.

Referring to FIG. 2, wall panel 24 generally includes a lightweight precast concrete slab 30, a pair of side channels 32*a*, and a plurality of attachment channels 32*b*. Slab 30 is preferably formed of concrete that is predominately reinforced by steel reinforcement members (i.e., not fiberglass reinforced concrete). Side channels 32*a* and attachment channels 32*b* are partially embedded in concrete slab 30 and extend substantially perpendicular to one another. Referring to FIGS. 1 and 2, attachment channels 32*b* are used to reinforce slab 30 and to attach wall panel 24 to support wall 26, as described in detail below. Side channels 32*a* provide reinforcement of slab 30 in a direction perpendicular to the reinforcement provided by attachment channels 32*b*. Each side channel 32*a* also provides attachment openings 33 through which lifting elements 35 can be extended so that wall panel 24 can be lifted and entirely supported by lifting elements 35. As shown in FIG. 1, a cable 36 can be attached to lifting elements 35 (shown in FIG. 2) in order to allow lift 22 to manipulate wall panel 24 proximate support wall 26 during erection of wall panel 24. Referring again to FIG. 2, attachment openings 33 and lifting elements 35 can also be used to remove wall panel 24 from the form within which it is made. In an alternative embodiment, attachment openings 33 can be formed in attachment channels 32*b*, thereby allowing wall panel 24 to be lifted and placed with attachment channels 32*b* having a generally upright orientation.

Referring to FIG. 2, elongated channels 32*a, b* of wall panel 24 are rigidly coupled to concrete slab 30 by partial embedding channels 32*a, b* in slab 30. Channels 32*a, b* project outwardly from a substantially flat inside surface 36 of slab 30. Each of channels 32*a, b* presents a generally flat outer channel surface 38 that is spaced from and extends substantially parallel to inside surface 36 of slab 30. Outer channel surfaces 38 of all channels 32*a, b* are preferably substantially coplanar. The pair of side channels 32*a* extend substantially parallel to one another proximate opposite sides of slab 30. Attachment channels 32*b* extend substantially parallel to one another and substantially perpendicular to side channels 32*a*. A substantial portion (preferably all) of attachment channels 32*b* are disposed between side channels 32*a*. It is preferred for side channels 32*a* to have a continuous length that is at least about 65 percent of the length (vertical direction in FIGS. 1 and 2) of slab 30, most preferably at least 75 percent of the length of slab 30. It is preferred for attachment channels 32 to have a continuous length that is at least about 65 percent of the width (horizontal direction in FIGS. 1 and 2) of slab 30, most preferably at least 75 percent of the width of slab 30. Side channels 32*a* are laterally spaced inwardly from and run generally parallel to opposite side edges of slab 30. Preferably, side channels 32 are spaced inwardly from opposite side edges of slab 30 a distance that is less than about 10 percent of the total width of slab 30, more preferably between 0.5 percent and 5 percent of the total width of slab 30. In a preferred embodiment of the present invention, side channels 32 are spaced inwardly from the side edges of slab 30 a distance in the range of from about 1 inch to about 12 inches, most preferably in the range of from 2 inches to 6 inches. The spacing between attachment channels 32*b* is preferably in the range of from about 5 percent to about 35 percent of the total length of slab 30, more preferably 10 percent to 25 percent of the total length of slab 30. In a preferred embodiment of the present invention, the spacing between attachment channels 32*b* is in the range of from about 0.5 to about 5 feet, more preferably in the range of from about 1 to about 3 feet, and most preferably in the range of from 1.5 to 2.5 feet.

The shape, size, and weight of wall panel 24 can vary greatly depending on the particular application for which wall panel 24 is used. However, it is an object of the present invention to provide a durable concrete wall panel that is significantly lighter than traditional concrete wall panels. Thus, it is preferred for wall panel 24 to have a weight in the range of from about 5 to about 30 pounds per square foot, more preferably in the range of from about 10 to about 20 pounds per square foot, and most preferably in the range of from 12 to 18 pounds per square foot. It is further preferred for the thickness of slab 30 to be in the range of from about 1 to about 4 inches, more preferably in the range of from about 1.25 to about 3 inches, and most preferably in the range of from 1.5 to 2 inches. Although the length and width of slab 30 can vary greatly depending on the specific application for which slab 30 is fabricated, it is preferred for slab 30 to have a length in the range of from about 4 to about 20 feet and a width in the range of from about 4 to about 15 feet, more preferably a length in the range of from 8 to 16 feet and a width in the range of from 6 to 12 feet. Because attachment channels 32*b* provide the means by which wall panel 24 is coupled to support wall 26 (shown in FIG. 1), it is important that attachment channels 32*b* are embedded in slab 30 in a manner which prevents "pull out" of attachment channels 32*b* from slab 30. Thus, each attachment channel 32*b* preferably has a pull out strength of at least 250 pounds per lineal foot. Preferably, each attachment channel 32*b* has a pull out strength in the range of from about 500 to about 1,000 pounds per foot, and most preferably in the range of from 1,000 to 3,000 pounds per foot. Each channel 32*a, b* is preferably formed of a single piece of bent sheet metal. Preferably, the sheet metal used to form channels 32 is a 14 to 26 gauge sheet metal, most preferably an 18 to 22 gauge sheet metal.

Figure 3:
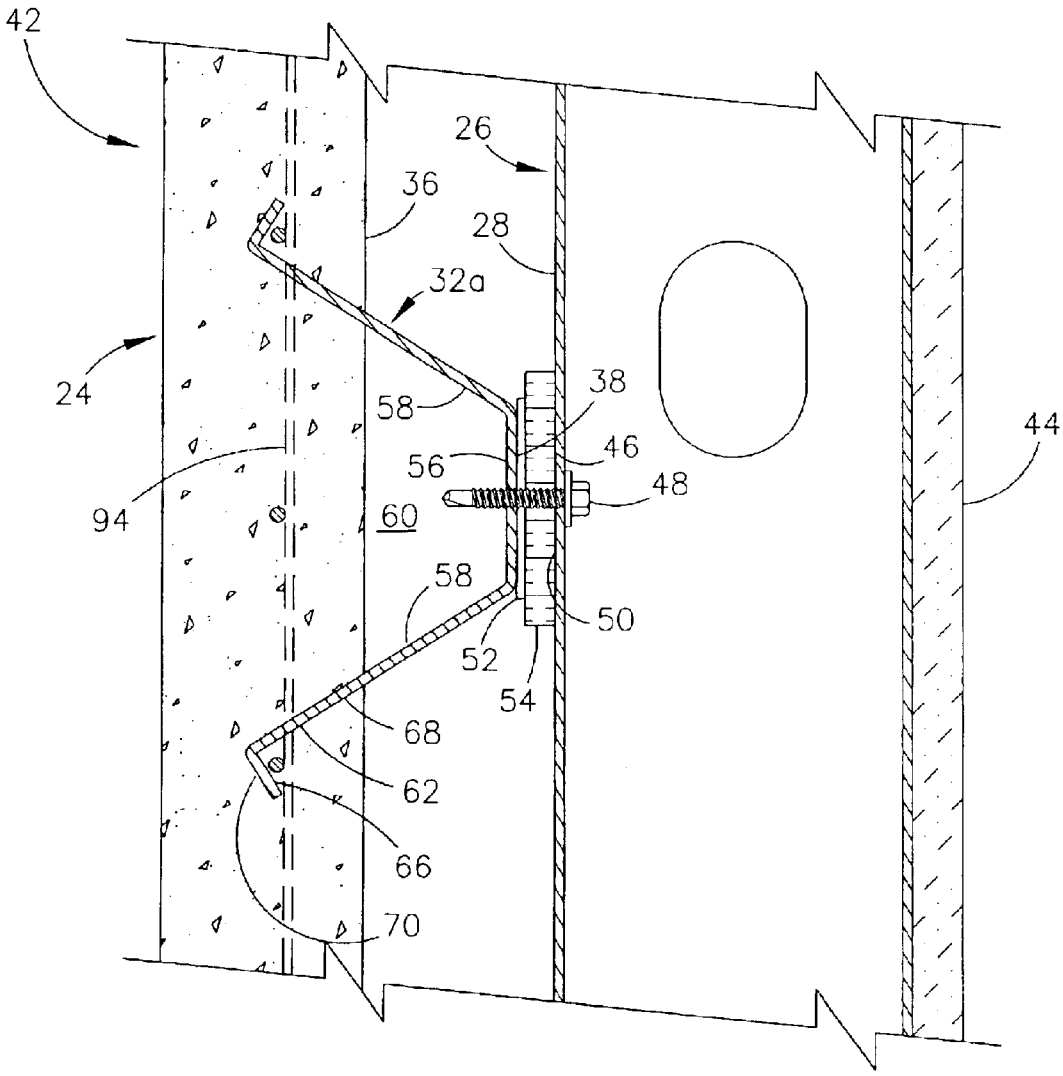
FIG. 3 is a partial sectional view of a wall system constructed in accordance with the principles of the present invention, particularly illustrating the manner in which the prefabricated wall panel is coupled to the support wall by extending a self-tapping screw through a thin metal framing member of the support wall and a metallic channel of the prefabricated wall panel.

Referring to FIG. 3, a wall system 42 is illustrated as generally comprising wall panel 24, support wall 26, and an interior wall 44. Attachment channel 32*b* of wall panel 24 is coupled to thin metal framing member 28 (illustrated as a C-shaped metal stud) of support wall 26 at an attachment location 46 where attachment channel 32*b* crosses metal framing member 28. Referring to FIGS. 1–3, when wall panel 24 is placed adjacent support wall 26, it is preferred for the direction of elongation of spaced-apart attachment channels 32*b* to be substantially perpendicular to the direction of elongation of spaced-apart metal framing members 28 so that a plurality of attachment locations 46 are available at points where attachment channels 32*b* cross metal framing members 28. Referring again to FIG. 3, it is preferred for wall panel 24 to be attached to thin metal framing members 28 at each attachment location 46 via a self-tapping screw 48 that extends through metal framing member 28 and attachment channel 32*b*. As used herein, the term "self-tapping screw" shall denote a screw having a threaded shaft and an unthreaded tip that is configured similar to the tip of a standard drill bit. The tip of the self-tapping screw is operable to create a hole in sheet metal or another relatively thin material. The hole created by the tip has a sufficient diameter to allow the threaded shaft to be threaded therethrough, thereby firmly attaching the self-tapping screw to the sheet metal or other thin member. A variety of self-tapping screws suitable for use in the present invention are commercially available from various suppliers.

The use of self-tapping screws 48 as the primary means for attaching wall panel 24 to support wall 26 and supporting wall panel 24 on support wall 26 provides numerous advantages. For example, the alignment of wall panel 24 relative to support wall 26 can be readily adjusted because a proper attachment location 46 can be formed at any location where attachment channel 32*b* crosses thin metal framing member 28. Further, it is not necessary for the outer channel surface 38 of each attachment channel 32*b* to fit flushly with the outer framing member surface 50 of each metal framing member 28 because a shim 52 can readily be placed between outer channel surface 38 of attachment channel 32*b* and outer framing member surface 50 of metal framing member 28 to fill any gap between thin metal framing member 28 and attachment channel 32*b* prior to extending self-tapping screw 48 through metal framing member 28, shim 52, and attachment channel 32*b*. Further, this configuration for attaching wall panel 24 to support wall 26 allows thermal insulation 54 to be placed between outer channel surface 38 and outer framing member surface 50 at each attachment location 46. Such thermal insulation 54 can enhance the thermal efficiency of wall system 42 by inhibiting thermal conduction between attachment channel 32*b* and metal framing member 28.

Because self-tapping screw 48 is the preferred means for coupling attachment channel 32*b* to metal framing member 28, metal framing member 28 and attachment channel 32*b* must be configured to allow self-tapping screw 48 to extend therethrough. Thus, it is preferred for both metal framing member 28 and attachment channel 32*b* to be formed of thin metal. Preferably, the thickness of metal framing member 28 and attachment channel 32*b*at attachment location 46 is in the range of from about 0.01 to about 0.2 inches, more preferably in the range of from about 0.02 to about 0.1 inches, and most preferably in the range of from 0.03 to 0.05 inches. This thickness of metal framing member 28 and attachment channel 32*b* is thin enough to allow self-tapping screw 48 to readily create a hole in metal framing member 28 and metallic attachment channel 32*b*, but is thick enough to allow formation of a suitably strong connection between metal framing member 28 and metallic attachment channel 32*b* via self-tapping screw 48.

Figure 4:
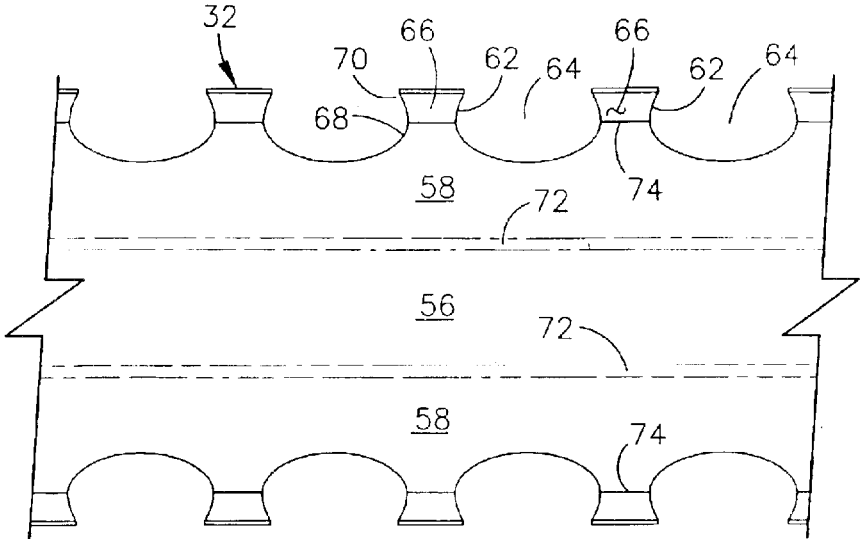
FIG. 4 is a partial top view of a metallic channel suitable for use in the inventive prefabricated wall panel.
Figure 5:
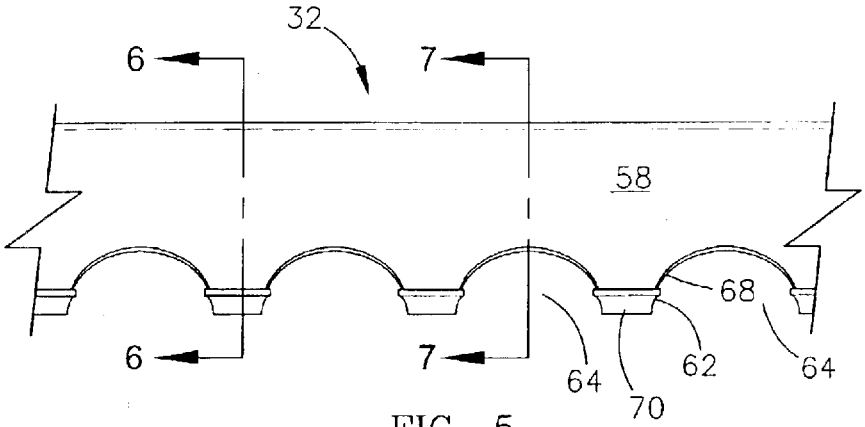
FIG. 5 is a partial side view of the metallic channel shown in FIG. 4.
Figure 6:
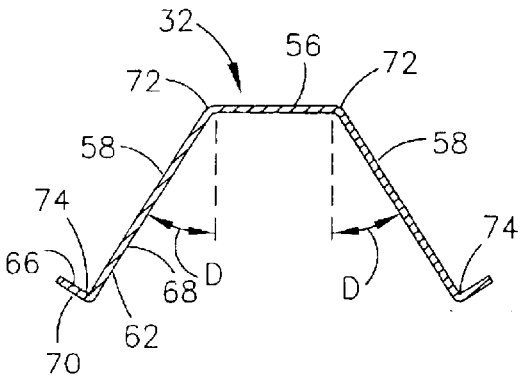
FIG. 6 is a sectional view of the metallic channel taken along line 6—6 in FIG. 5, particularly illustrating the generally hat-shaped configuration of the metallic channel.
Figure 7:
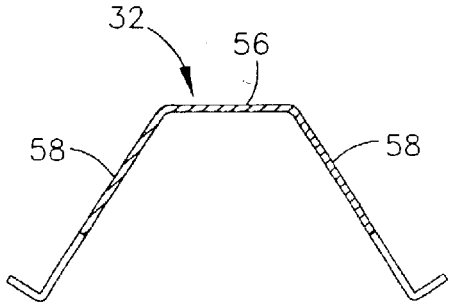
FIG. 7 is a sectional view of the metallic channel taken along line 7—7 in FIG. 5.

Referring now to FIGS. 3–7, the configuration of channel 32 (i.e., side channel 32*a* and/or attachment channel 32*b*) is an important aspect of one embodiment of the present invention. Properly configured channels 32 provide outstanding reinforcement of the relatively thin concrete slab. Each channel 32 preferably includes a substantially flat cross member 56 and a pair of side members 58 extending from generally opposite edges of cross member 56. Referring again to FIG. 3, self-tapping screw 48 is extended through metal framing member 28 and cross member 56 in order to attach wall panel 24 to support wall 26. In order to provide sufficient space for self-tapping screw 48 to extend through cross member 56, a gap 60 must exist between cross member 56 and inside surface 36 of slab 30. Gap 60 allows self-tapping screw 48 to be extended through thin metal framing member 28 and cross member 56 without contacting slab 30. It is preferred for gap 60 (defined between cross member 56 and inside surface 36 of slab 30) to be in the range of from about 0.25 to about 4 inches, more preferably in the range of from about 0.5 to about 3 inches, and most preferably in the range of from 1 to 2 inches. Referring to FIG. 6, it is preferred for cross member 56 to have a width in the range of from about 0.5 to about 4 inches, more preferably in the range of from 0.75 to 2 inches. It is further preferred for each side member 58 to have a length in the range of from about 1 to about 5 inches, more preferably in the range of from 1.5 to 3.5 inches. Referring again to FIG. 6, it is preferred for side members 58 of each channel 32 to diverge from one another as they extend from cross member 56. A divergence angle D is defined between each side member 58 and an imaginary plane extending perpendicular to cross member 56 along the junction of side member 58 and cross member 56. Preferably, divergence angle D is in the range of from about 10 to about 60 degrees, more preferably in the range of from about 15 to about 45 degrees, and most preferably in the range of from 25 to 35 degrees.

Referring again to FIG. 3, each side member 58 is partially embedded in slab 30. Thus, each side member 58 includes an embedded portion (embedded in slab 30) and an exposed portion (not embedded in slab 30). Preferably, 20 to 80 percent of each side member 58 is embedded in slab 30. Most preferably, 30 to 50 percent of each side member 58 is embedded in slab 30. Preferably, the embedded portion of each side member 58 extends below inside surface 36 of slab 30 a distance in the range of from about 0.25 inches to about 2 inches, most preferably in the range of from 0.5 to about 1 inch. Preferably, the exposed portion of each side member 58 extends outwardly from inside surface 36 of slab 30 a distance in the range of from about 0.5 to about 4 inches, more preferably in the range of from about 0.75 to about 3 inches, and most preferably in the range of from 1.0 to 2.0 inches.

Referring to FIGS. 3–7, each side member 58 includes a plurality of projections 62 defined between a plurality of notches 64. Referring to FIGS. 4 and 5, projections 62 of each side member 58 are preferably spaced on 1 to 4 inch centers, more preferably on 1.5 to 2.5 inch centers. Preferably, each notch 64 extends into the side member 58 a distance in the range of from about 0.25 to 2 inches, most preferably in the range of from 0.5 to 1 inch.

Referring to FIG. 3, each projection 62 is embedded in slab 30 and defines a holding surface 66 adapted to prevent pull out of channel 32 from slab 30. Preferably, holding surface 66 faces generally towards inside surface 36 of slab 30 and is defined along a plane that is generally transverse to the plane along which the exposed portion of corresponding side member 58 is defined. It is preferred for each holding surface 66 of each projection 62 to present an area in the range of from about 0.05 to about 1 inch, most preferably in the range of from 0.2 to 0.5 inches. Referring to FIGS. 3–7, each projection 62 preferably includes a leg 68 and a foot 70. Leg 68 is embedded in slab 30 and is substantially coplanar with the exposed portion of side member 58. Foot 70 is embedded in slab 30 and presents holding surface 66. Foot 70 is defined along a plane that extends generally transverse to the plane along which the exposed portion of side member 58 is defined. Referring to FIGS. 4 and 6, it is preferred for each channel 32 to be formed of a single piece of bent sheet metal. Thus, two substantially parallel top bend lines 72 define the junction between cross member 56 and side members 58, and two series of substantially parallel bottom bend lines 74 define the junction between leg 68 and foot 70 of each projection 62.

Referring to FIGS. 8 and 9, the configuration of a concrete form 90, reinforcing members 94, side channels 32*a*, and attachment channels 32*b* are illustrated prior to concrete placement in form 90. It is preferred for steel reinforcing members 94 (e.g., steel mesh or rebar) to be placed in form 90 prior to placement of channels 32*a,b* in form 90. Referring to FIG. 9, notches 64 in channels 32*a, b* provide openings through which steel reinforcing members 94 can extend. FIG. 9 also illustrates a dashed fill line 96 up to which concrete can be placed in form 90.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A lightweight precast wall panel comprising:

a concrete slab;

a pair of elongated spaced-apart first channels; and a plurality of elongated spaced-apart second channels, said first channels extending substantially parallel to one another, said second channels extending substantially parallel to one another, said first and second channels being partially embedded in the slab and extending substantially perpendicular to one another, at least some of said second channels being disposed generally between the first channels, each of said first and second channels including a substantially flat cross member and a pair of spaced-apart side members extending from the cross member, said side members being partially embedded in the slab, said cross member being spaced from the slab, said cross member being spaced at least about 0.25 inches from the slab.

2. The wall panel according to claim 1, said slab presenting a substantially flat inside surface from which the first and second channels project, said cross member being defined along a plane that is at least substantially parallel to the inside surface of the slab.

3. The wall panel according to claim 2, said cross member being spaced from the inside surface of the slab a distance in the range of from about 0.5 to about 3 inches.

4. The wall panel according to claim 3, said cross member being formed of metal, said cross member having a thickness in the range of from about 0.02 to about 0.1 inches.

5. The wall panel according to claim 1, each of said cross members of said second channels presenting a respective substantially flat outer channel surface, said outer channel surfaces of said second channels being substantially coplanar.

6. The wall panel according to claim 1, said side members diverging from one another as the side members extend away from the cross member, said side members extending from the cross member at a divergence angle in the range of from about 10 to about 60 degrees.

7. The wall panel according to claim 1, each of said side members including a proximal end proximate the cross member and a distal end at least partly embedded in the slab, said distal end of the side member presenting a plurality of projections defined between a plurality of notches.

8. The wall panel according to claim 7, each of said projections extending at least 0.5 inches into the slab, each of said notches extending in the range of from about 0.25 to about 2 inches into the side member with which that notch is associated.

9. The wall panel according to claim 7, each of said projections presenting a holding surface embedded in the slab, said holding surface being adapted to substantially prevent the channel with which the holding surface is associated from pulling out of the slab, said holding surface facing more towards the cross member with which that holding surface is associated than away from the cross member with which that holding surface is associated.

10. The wall panel according to claim 7, each of said projections including a substantially flat leg portion and a substantially flat foot portion, each of said foot portions being entirely embedded in the slab, each of said foot portions extending along a plane that is transverse to the plane along which the leg portion associated with that foot portion extends.

11. The wall panel according to claim 7, said cross member being coupled to and extending generally between the proximal ends of the side members.

* * * * *